United States Patent [19]

Mayer

[11] Patent Number: 4,552,180

[45] Date of Patent: Nov. 12, 1985

[54] PILOT OPERATED CONTROL VALVE FOR HYDRAULICALLY ACTUATED RECIPROCATING PUMP

[76] Inventor: James R. Mayer, 7344 S. Alton Way, Englewood, Colo. 80112

[21] Appl. No.: 634,355

[22] Filed: Jul. 25, 1984

Related U.S. Application Data

[62] Division of Ser. No. 456,597, Jan. 10, 1983, Pat. No. 4,477,232.

[51] Int. Cl.[4] ..... F15B 13/042

[52] U.S. Cl. ..... 137/625.66; 137/624.14

[58] Field of Search ..... 91/304, 392; 137/624.14, 625.63, 625.66

[56] References Cited

U.S. PATENT DOCUMENTS 3,015,317 1/1962 Buchanan ..... 137/625.63 X 3,209,782 10/1965 Wolpin et al. ..... 137/625.62

FOREIGN PATENT DOCUMENTS 2326349 12/1973 Fed. Rep. of Germany ..... 137/625.63

1012961 12/1965 United Kingdom ..... 137/625.66

*Primary Examiner*—Gerald A. Michalsky

*Attorney, Agent, or Firm*—Pravel, Gambrell, Hewitt & Kimball

[57] ABSTRACT

A pilot pressure fluid operated spool type power fluid distributing valve for operating a hydraulically powered reciprocating piston pump includes a spool closure member with opposed unequal diameter bores formed in the spool ends. Pilot actuator pistons project into the bores and include pilot pressure fluid passages opening into the bores from sources of pilot control fluid. The bore of smaller diameter includes an enlarged annular chamber which may be closed by a cooperating ridge on the associated piston and a reentrant edge of the bore so that the closure member may be biased in one position if already in that position until a predetermined pilot fluid pressure is present in the opposite bore.

6 Claims, 10 Drawing Figures

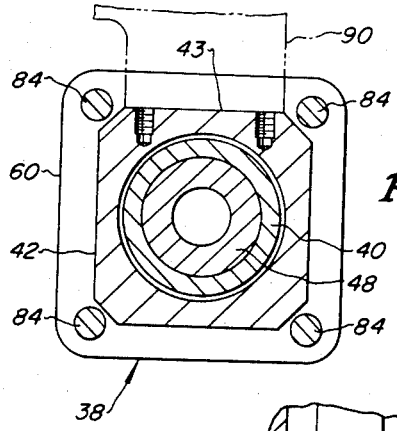
Fig. 5
Fig. 9
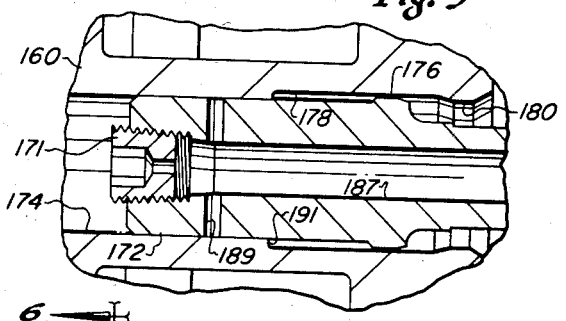
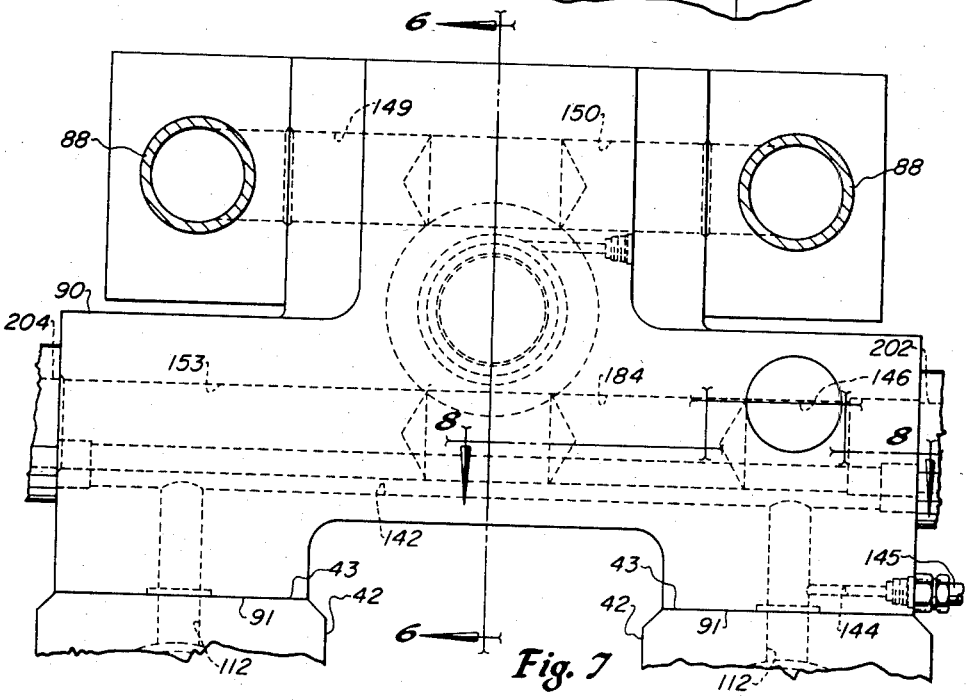
Fig. 7

PILOT OPERATED CONTROL VALVE FOR HYDRAULICALLY ACTUATED RECIPROCATING PUMP

This application is a division of application Ser. No. 456,597, filed Jan. 10, 1983, now U.S. Pat. No. 4,477,232.

BACKGROUND

The present invention pertains to a pilot operated power fluid distributing valve which is particularly useful in conjunction with a control system for a hydraulically actuated reciprocating piston pump. In the art of reciprocating piston pumps and similar hydraulically actuated devices it is desirable to utilize a pilot operated control valve for alternately valving high pressure fluid to one or more hydraulic power pistons of the pump or other similar type apparatus. Some of the disadvantages of prior art hydraulically actuated pumps and similar apparatus pertain to the lack of control means which will suitably time the actuation of the power cylinders. There is, of course, an ever present need for improvements in control valving and, in particular, for control valving which will maintain a predetermined position until operated in response to a suitable pilot pressure fluid signal, and which is also capable of shifting to a predetermined position to assure that a pump or similar apparatus will start operating in the event that equal pilot control pressures are applied to shift the valve from one position to another.

SUMMARY OF THE INVENTION

The present invention provides an improved pilot operated supply or distributing valve particularly useful in a fluid control circuit for a hydraulically actuated reciprocating piston pump.

In accordance with one aspect of the present invention there is provided a spool type pilot pressure fluid operated distributing valve which is adapted to provide for starting the pump or similar apparatus regardless of the initial position of the distributing valve and to prevent premature shifting of the valve during normal cyclic operation.

In accordance with another aspect of the invention there is provided a control valve which will remain in a selected position until a predetermined pilot pressure fluid signal overcomes another pilot pressure fluid signal acting to hold the valve closure member in the selected position.

Those skilled in the art will recognize and appreciate the features of the present invention described hereinabove as well as other superior aspects of the invention upon reading the detailed description which follows in conjunction with the drawings.

BRIEF DESCRIPTION OF THE DRAWINGS

FIG. 5 is a detail section view taken along the line 5—5 of FIG. 3;

FIG. 7 is a side elevation of the power fluid valve housing and manifold;

FIG. 9 is a detail view of a portion of the valve shown in FIG. 6; and

DESCRIPTION OF THE PREFERRED EMBODIMENT

Figure 1:
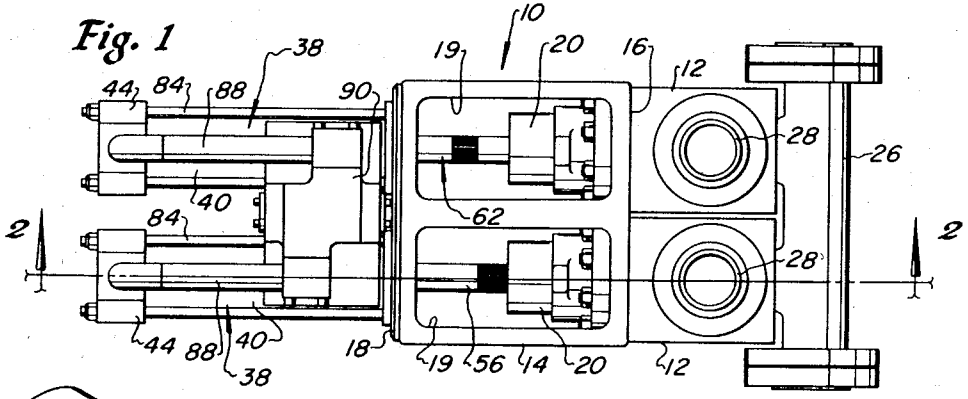
FIG. 1 is a top plan view of a hydraulically actuated reciprocating piston pump in accordance with the present invention.

In the description which follows like parts are marked throughout the specification and drawings with the same reference numerals, respectively. The drawings are not necessarily to scale and certain features of the invention may be exaggerated in scale or shown in schematic form to better illustrate the inventive concept.

Figure 2:
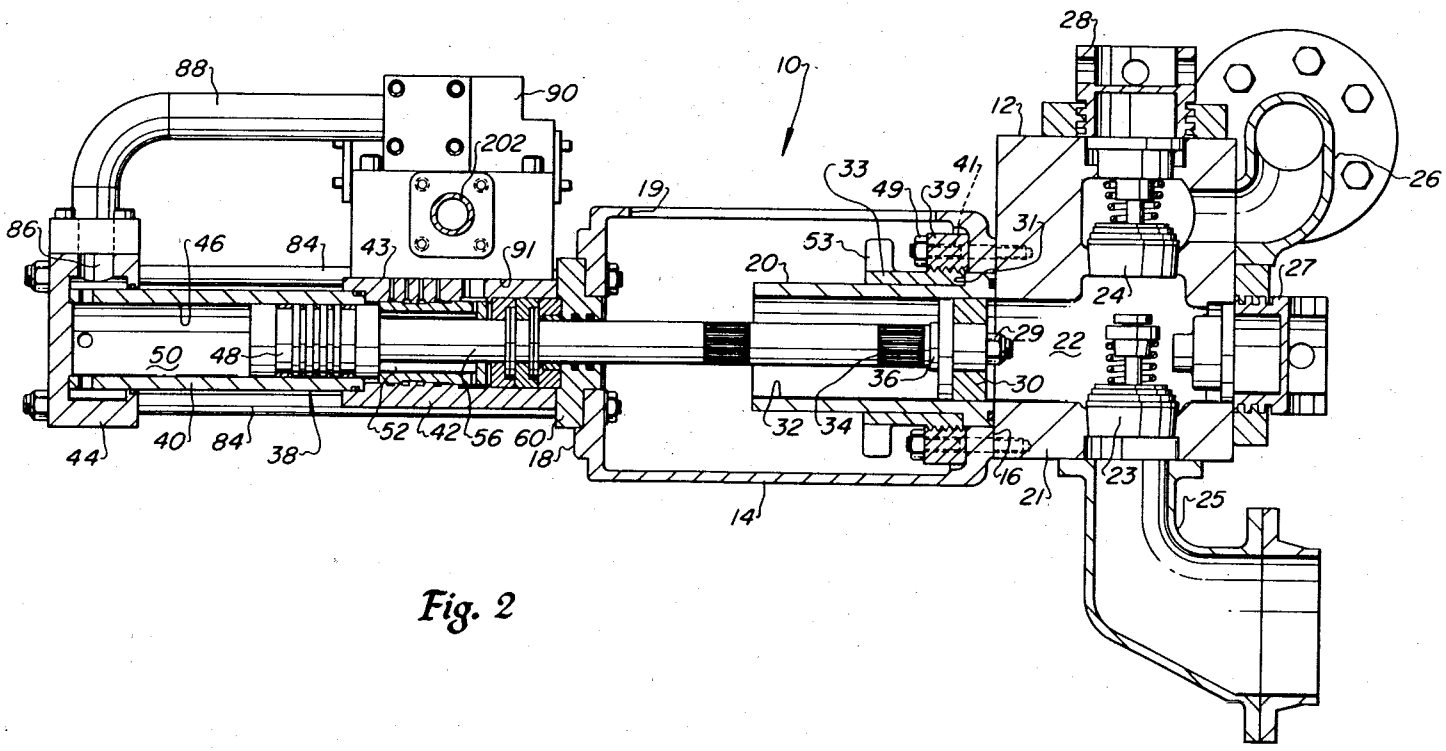
FIG. 2 is a side section view taken along line 2—2 of FIG. 1 through one cylinder assembly.

Referring to FIGS. 1 and 2, there is illustrated a hydraulically actuated multi-cylinder reciprocating piston pump generally designated by the numeral 10. The pump 10 is of the so-called duplex single acting type having side-by-side working fluid cylinder assemblies, each designated by the numeral 12, and which are suitably mounted on a support frame 14. Those skilled in the art will recognize that the embodiment of a dual cylinder pump is merely illustrative and that the invention may be used in other pump configurations. The pump 10 is particularly adapted for pumping a working fluid such as well drilling mud or the like although the pump may be adapted for pumping fluids in other applications. The frame 14 is a generally rectangular boxlike housing having opposed end faces 16 and 18 and relatively large openings 19 formed in the top wall to provide access to certain parts of the pump.

Referring particularly to FIG. 2, as shown by way of example, the cylinder assemblies 12 are each suitably bolted to the frame end face 16 and include an elongated cylinder member or liner 20. The cylinder assemblies 12 are of substantially conventional construction except as noted herein and include a housing portion 21 having an interior chamber 22 and suitable bores for receiving suction and discharge valve assemblies 23 and 24. The chambers 22 of each of the cylinder assemblies 12 are in communication with common fluid inlet and discharge manifolds 25 and 26, respectively. Access to the interior chambers 22 and the respective valve assemblies is provided by removable covers 27 and 28. The cylinder assemblies 12 are also each adapted to support a reciprocating working fluid piston 30 which is reciprocable in a bore 32 in the liner and forming a part of the chamber 22. The pistons 30 are also of conventional construction and are each secured to an elongated piston rod, generally designated by the numeral 34, including a transverse flange portion 36 and a threaded end portion having a lock nut 29 disposed thereover and adapted to secure the rod in assembly with the piston 30.

The piston rods 34 extend axially from the respective cylinder liners 20 and are in driven engagement with respective hydraulic linear cylinder and piston type actuators, each generally designated by the numeral 38. The hydraulic actuators 38 basically comprise double acting cylinder and piston type actuators having an elongated cylinder 40, a sleeve valve housing portion 42 disposed at one end of the cylinder 40, and a head part 44 disposed at the opposite end of the cylinder 40. The cylinders 40, a representative one of which is shown in the section views of FIGS. 2 and 3, includes an elongated cylindrical bore 46 and a piston 48 disposed therein and in slidably sealing engagement with the bore wall and dividing the cylinder into opposed fluid chambers 50 and 52.

Figure 3:
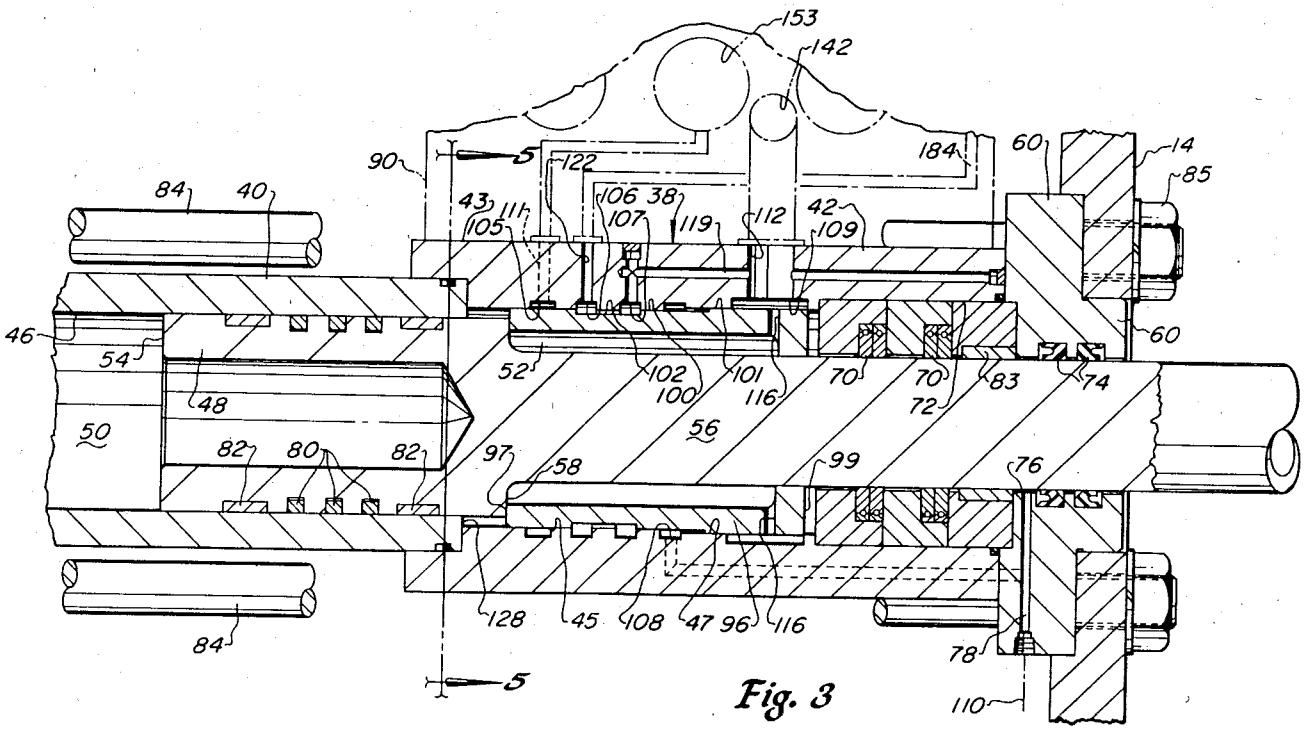
FIG. 3 is a detail section view on a larger scale of one of the power fluid actuators of the pump of FIGS. 1 and 2.

Referring particularly to FIG. 3, the piston 48 includes a first transverse end face 54 and an opposed axially extending reduced diameter rod portion 56 forming a transverse shoulder 58. The rod portion 56 extends through the valve housing portion 42, through an end cap member 60, through the frame end wall defining the face 18 and is threadedly connected to the piston rod 34.

Figure 4:
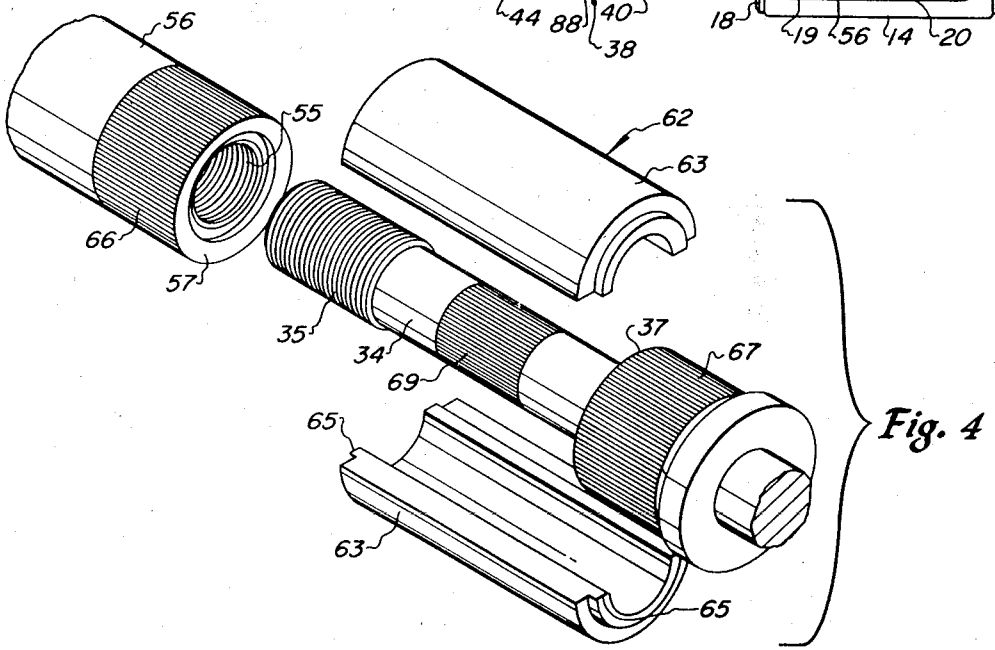
FIG. 4 is a detail view of the coupling between the working fluid piston and the piston of the hydraulic power fluid actuator.

In accordance with one aspect of the present invention the connection formed between the hydraulic piston rod 56 and the working fluid piston 34 is formed by an improved arrangement for reducing the compressive column load on the piston rod 34 during operation of the pump. Due to the differences in diameters of the piston 30 and the piston 48 and rod 34 must be made suitably small enough that a threaded end portion 35, see FIG. 4, may be connected to a cooperating internally threaded end 55 of the rod portion 56 while yet leaving a sufficient amount of material in the rod portion 56 to withstand the working stresses. Moreover, in order to minimize the length of the pump 10 between the respective cylinder assemblies 12 and the actuators 38 it is necessary to reduce the diameter of rod 34 to facilitate insertion and removal of the rod and piston assembly with respect to the liner 20 without disassembling either the cylinders 12 or the actuators 38 from the frame 14. However, since the piston rod 34 must be of a relatively small diameter as compared with the piston rod portion 56 the cross-sectional area available to withstand the axial compressive stresses on the rod may be insufficient.

Accordingly, a split sleeve tubular column member, generally designated by the numeral 62, is provided for insertion between the end face 57 of the rod 56 and a transverse face 37 on the piston rod 34. The column member 62 includes opposed cylindrical half sleeve sections 63 which are each provided with annular axially projecting tongue portions 65 projecting from the opposite end faces thereof and which extend into cooperating recesses formed in the faces 37 and 57. The rod portion 56 is provided with a suitable wrench engaging knurled portion 66 and the piston rod 34 is also provided with suitable knurled wrench engaging surfaces 67 and 69 to permit connection and disconnection of the rod 34 with respect to the rod 56.

Upon assembly of the rod 34 to the rod 56 the coupling half sections 63 are inserted in place as shown in FIG. 2 and the threaded connection between the rod 34 and 56 is tightened until the opposed end faces of the coupling sections 63 are in abutting engagement with the faces 57 and 37, respectively. Accordingly, axial compressive loading on the rods 34 will be shared with the members 62 to distribute the stresses across the full cross-sectional area delimited by the diameter of the couplings.

The liners 20 are each retained in assembly with the housing 21 by a unique connector arrangement, as illustrated in FIG. 2, to provide for removing the liner from the pump 10 without disassembling the cylinder assembly 12 from the frame 14. The liner 20 is provided with a transverse shoulder 31 which is in abutting engagement with a retaining nut 33. The nut 33 is externally threaded and is threadedly engaged with a collar 39 which is secured to the frame 14 by a plurality of studs 41 which are threadedly engaged with the cylinder housing 21, project through cooperating clearance holes in the frame end face 16 and are provided with locknuts 49. The nut 33 includes a suitable number of radially projecting hammer lugs 53 formed thereon. The liner 20 may be removed from the pump 10 by unthreading the nut 33 and sliding the liner to the left, viewing FIG. 2, until it can be removed through the opening 19. Removal of the liner 20 is, of course, preceded by disassembly of the piston rod 34 from the rod 56.

Referring further to FIG. 3, the piston rod portion 56 extends through suitable high pressure seals 70 disposed in a recess 72 formed in the valve housing 42 and through low pressure lip type seals 74 disposed in suitable recesses formed in the end cap 60. An annular channel 76 is formed between the seals 70 and 74 and which is in communication with a passage 78 for draining hydraulic fluid that has leaked past the seals 70. The piston 48 is provided with pressure seal means comprising annular seal rings 80 which are disposed in suitable annular grooves formed in the piston between spaced apart piston bearings 82. The bearings 82 comprise annular split sleeve type members preferably formed of a suitable fluorocarbon filled plastic material. A rod bearing 83 is also provided disposed in a suitable support member in the recess 72.

As shown in FIGS. 2, 3 and 5, the cylinder 40, the valve housing 42, the head 44 and the end cap 60 are held in assembly by elongated threaded tie rods 84 which are threadedly engaged with and project through the end cap and are secured to the frame 14 by nuts 85. The head 44 includes a hydraulic power fluid inlet passage 86, FIG. 2, in communication with an inlet conduit 88 leading thereto from a valve housing and manifold block 90. The valve housing 90 is mounted on the respective actuator valve housings 42 on cooperating face portions 43 and 91, respectively.

Referring particularly to FIG. 3, each of the actuators 38 is provided with a unique pilot control valve arrangement including an elongated tubular sleeve valve 96 which is slidably disposed in a bore 45 of the valve housing 42 and is slidably disposed in sleeved relationship over the piston rod portion 56. One end of the sleeve valve 96, designated by the numeral 97, is engageable with the shoulder 58 in response to movement of the piston 48 to the right, viewing FIG. 3, for shifting the valve to the piston shown. The sleeve valve 96 is provided with stepped outer diameters 100 and 101 which are slidable in the bore 45 and a slightly larger bore portion 47 in the valve housing 42, respectively. The sleeve valve 96 also includes an elongated annular recess or groove 102 intermediate the end face 97 and an opposed end face 99.

As shown in FIG. 3, the valve housing 42 is provided with a plurality of axially spaced apart grooves intersecting the bore 45 and designated by the numerals 105, 106, 107, 108 and 109, respectively. The groove 105 is adapted to be in communication with a passage 111 leading to a suitable passage in the housing 90 which is connected to a low pressure return conduit for the control system of the pump 10. The groove 108 is suitably interconnected with the passage 78 and a low pressure return conduit shown schematically in FIG. 10 and indicated by the numeral 110. The groove 109 is in communication with a passage 112 which opens into the chamber 52 defined generally by the bore 45, the piston rod portion 56 and an end face formed by the seal assembly 70. The sleeve valve 96 is slidable in the chamber 52 and includes radially extending passages 116 providing communication between both ends of the chamber. The chamber 52 of each cylinder actuator 38 is in communication with the corresponding chamber of the other actuator and with a source of hydraulic pressure fluid by way of a charge pump 118 indicated schematically in FIG. 10. The groove 107 is also in communication with the passage 112 by way of a connecting passage 119 shown in FIG. 3. Accordingly, pressure fluid at a predetermined intermediate pressure, for example, approximately 400 psig, is constantly applied to the chamber 52 and to the groove 107.

When sleeve valve 96 is in the position shown in FIG. 3 the groove 107 is in communication with the groove 106 by way of the recess 102. The groove 106 is connected to a passage 122 which leads to the pilot actuator of a unique two position valve, generally designated by the numeral 124 in FIG. 10, and which will be described in further detail herein. Since the groove 108 is in communication with a low pressure return conduit an annular cross-sectional face area of the sleeve valve 96, delimited by the diameters 100 and 101, is constantly exposed to low fluid pressure and there is a net effective pressure force acting on the end face 99 of the valve which constantly biases the valve toward the shoulder 58. Accordingly, if the pressure of the hydraulic fluid in the chamber 50 of the cylinder 40 is reduced sufficiently that a net effective biasing force acting on the shoulder 58 is sufficient to move the piston 48 to the left, viewing FIG. 3, the piston and the sleeve 96 will move in unison until the sleeve end face 97 engages a transverse edge 128 formed by the cylinder 40 at the end of the bore 45. When the sleeve 96 has shifted to a second position as described above the recess 102 will place the grooves 105 and 106 in communication with each other so that pilot pressure fluid in passage 122 will be conducted to the low pressure return circuit.

Figure 6:
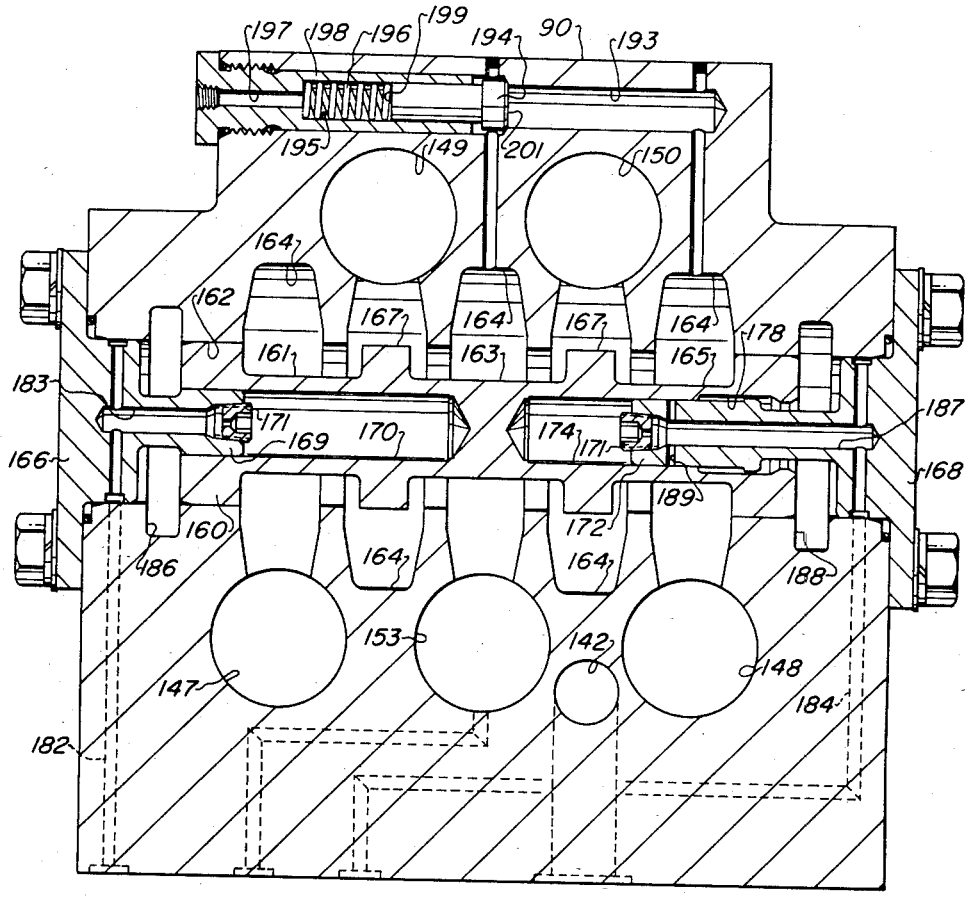
FIG. 6 is a longitudinal section view taken along line 6—6 of FIG. 7 through the main hydraulic power fluid supply valve for the power fluid actuators.
Figure 8:
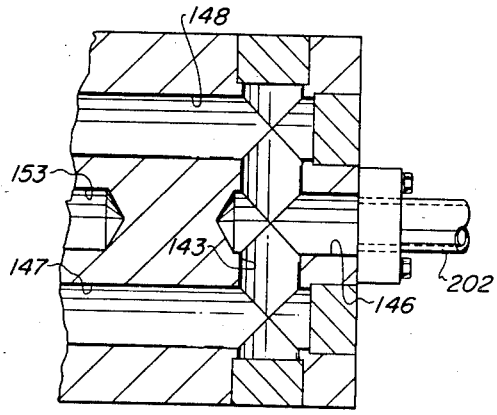
FIG. 8 is a detail section view taken along line 8—8 of FIG. 7.

Referring now to FIGS. 6 through 9 certain details of the unique pilot actuated valve 124 and the structure of the valve housing 90 will be described. A particular advantageous aspect of the pump of the present invention resides in the arrangement of the valve housing and manifold block 90 which includes conduit means for conducting substantially all of the hydraulic power fluid to and from the respective cylinder actuators 38 and the valve 124. In fact, it is necessary that only five external conduits are required to be connected to the manifold or housing 90 with respect to the hydraulic control circuit for the actuators 38. As previously described, the housing 90 is adapted to be bolted to the respective valve housings 42 so that the faces 43 and 91 are contiguous. Accordingly, the passages 112 and 122 in the housings 42 are aligned with corresponding passages formed in the housing 90. For example, the housing 90 includes a transfer passage 142, FIG. 7, interconnecting the passages 112 of each of the valve housings 42. The passage 142 is connected to the source of charge fluid from the charge pump 118 by a conduit 145 and a connecting passage 144. Referring briefly to FIG. 8 also, a main high pressure fluid supply passage 146 is formed in the housing 90 and is connected to additional branch passages 147 and 148 by a cross connecting passage 143. The passages 147 and 148 are in communication with respective fluid transfer grooves for the valve 124 to be described in further detail herein. As shown in FIGS. 6 and 7, the housing 90 also includes passages 149 and 150 which are in communication with respective ones of the conduits 88 leading to the chambers 50 of the respective actuators 38. Low pressure fluid being returned from the chambers 50 of the actuators 38 is conducted by way of the valve 124 through a return passage 153. In the interest of clarity and conciseness suffice it to say that the pilot actuating fluid passages interconnecting the valve 124 and the respective sleeve valves 96 are also formed in the housing 90.

Referring now particularly to FIG. 6, the power fluid distributing valve 124 comprises a spool member 160 slidably disposed in a bore 162 in the housing 90. The bore 162 is provided with suitable spaced apart lands formed by and between grooves 164 which are cooperable with grooves 161, 163, and 165 in the spool 160 to effect the transfer of fluid to and from the respective cylinder actuators 38 in accordance with the position of the spool with respect to the lands and grooves in the housing. The opposite ends of the bore 162 are closed by respective cover members 166 and 168. The cover member 166 includes a pilot actuator piston portion 169 which extends into a bore 170 formed in the spool 160. The cover member 168 includes a pilot piston portion 172 which projects into a bore 174 opposed to the bore 170 and slightly smaller in diameter than the bore 170. As shown in FIGS. 6 and 9, the pilot piston portion 172 includes a circumferential rim portion 176 which is cooperable with a groove formed by an enlarged diameter bore portion 178 and a circumferential reentrant edge of the bore portion designated by the numeral 180. The configuration of the piston portion 172 and the bore 174, 178 is operable to prevent premature shifting of the valve spool 160 as will be described in further detail herein. The bores 170 and 174 are adapted to be in communication with the passages 122 in each of the valve housings 42 by way of respective passages 182 and 184, FIG. 6. The pilot piston portions 169 and 172 are each preferably provided with interchangeable flow control orifice plugs 171 for controlling the shifting speed of the spool 160. The valve 124 is also provided with leakage flow drain passages 186 and 188 which are in communication with a drain line 190, see FIG. 10, which is connected to return line 110 leading to a fluid reservoir 192 for the hydraulic system of the pump 10.

The valve 124 is particularly adapted to operate in conjunction with the control system for the pump 10 with several unique operating characteristics. In accordance with one aspect of the valve 124, spaced apart lands 167, formed between the grooves 161, 163 and 165, FIG. 6, are somewhat underlapped with respect to the cooperating lands in the housing 90 so that, for example, when the spool 160 shifts from one valve position to the other a certain amount of high pressure fluid will short circuit from the passages 147 or 148 to the low pressure return passage 153. However, this configuration of the valve will substantially eliminate the need for an accumulator in the circuit supplying fluid to the working chambers 50 by way of the passages 149 or 150. Moreover, in order to prevent the spool 160 from being stuck in the centered position shown in FIG. 6, the bore 170 is slightly larger than the bore 174 so that, if and when equal fluid pressures are present in the pilot fluid passages 182 and 184, the spool will be biased into a position to the right of that shown in FIG. 6 to connect passage 150 with the low pressure return passage 153 and also connect the high pressure fluid supply passage 147 with the passage 149 leading to the associated chamber 50 of one of the cylinder actuators 38. In this way, the pump 10 will commence operating regardless of the initial position of the valve 160 when the hydraulic system is energized.

In accordance with another unique aspect of the valve 124 the reentrant edge 180 cooperates with the circumferential rim 176 and with the groove 178 to prevent premature shifting of the valve as a result of the unequal bore diameters 170 and 174. For example, if the spool 160 is shifted leftward, viewing FIG. 6, to its limit position the rim 176 will be in registration with the reentrant edge 180 to close off a chamber formed between the groove 178, the piston portion 172 and the rim 176. Pilot pressure fluid from the passage 184 will enter the aforementioned chamber by way of passages 187 and 189 in the piston portion 172 and act on the axially projected annular area formed by the surface 191, FIG. 9, to hold the spool 160 in the aforementioned position until the passage 184 is placed in communication with the low pressure return circuit and the bore 170 is placed in communication with a pilot fluid pressure signal by way of passages 182, 183 and the orifice plug 171.

The control system for the pump 10 is also provided with a pressure limiting valve to limit the peak pressures caused by introducing hydraulic fluid into the chambers 50 of the actuators 38 to accelerate the pistons 48. As shown in FIG. 6 the valve housing 90 is provided with a stepped bore cavity 193 and suitable passages interconnecting the high pressure passage 148 with the low pressure passage 153 by way of the respective grooves 164 associated with passages 148 and 153. The cavity 193 is closed at a seat formed by the juncture of its stepped bores by a spring loaded valve closure member 194 which is journalled in a bore 195 in a support member 198. The closure member 194 is urged into the position shown in FIG. 6 by a coil spring 196. The member 198 is threaded into the housing 90 as shown and is provided with a passage 197 opening into the bore 195 to introduce pressure fluid to act against a pressure face 199 of the closure member 194. An opposed face 201 on the closure member 194 is selected to be of the same effective cross-sectional area as the face 199.

Figure 10:
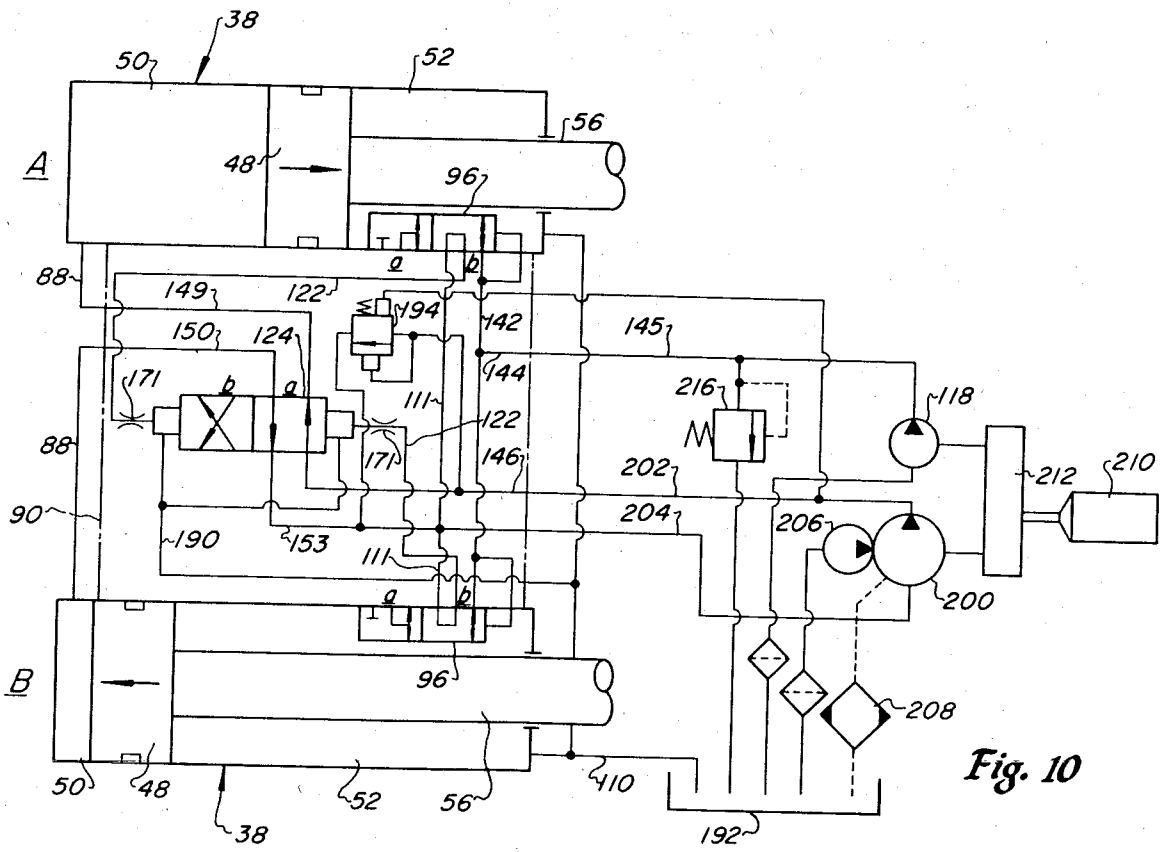
FIG. 10 is a schematic diagram of the hydraulic control circuit for the pump of the present invention.

Pressure fluid may be introduced into the bore 195 through a suitable pilot control line connected to a source of pressure fluid at a controllable pressure. However, the pilot control line in communication with the bore 195 is preferably connected to the discharge line of a pump 200 as shown in FIG. 10. The valve closure member 194 will unseat when the pressure in either passage 147 or 148 exceeds the pressure required to drive the pistons 48 on a working stroke by an amount determined by the spring 196, and the pressure of fluid acting on the face 199. Accordingly, by selection of the spring rate of the biasing spring 196 the pressure required to accelerate the pistons 48 may be selected to be that which is sufficient to suitably overcome friction of the piston seals and forces required to transfer fluid in and out of the actuator cylinders plus, of course, the pressure necessary to drive the actuator pistons on a working stroke. Since the passages 147 and 148 are interconnected by the common passage 146 the pistons of both actuators will be limited to a working pressure which is a predetermined incremental amount above the normal working pressure of the pump hydraulic power fluid supply system to thereby minimize pressure peaks caused by accelerating either of the actuator pistons.

Referring now to FIG. 10, there is illustrated a schematic diagram for the hydraulic control system for operating the hydraulic cylinder actuators 38. The actuators 38 are adapted to be supplied with hydraulic fluid by way of the main high pressure pump 200 which is interposed in a closed loop supply and return circuit including a high pressure fluid discharge line 202 in communication with passage 146 in housing 90 and a low pressure return fluid line 204 in communication with passage 153. A suitable charge pump 206 and a by-pass conduit with a heat exchanger 208 are also connected in circuit with the pump 200 is a conventional manner. The pump 200 is adapted to be driven by a suitable prime mover such as a diesel engine 210 driving the pump 200 through a power transmission unit 212. The power transmission 212 is also adapted to drive the charge pump 118 for supplying make up fluid to the transfer circuit including the cylinder chambers 52 and the main transfer passage 142. The maximum working pressure in the transfer circuit is controlled by a pressure limiting valve 216.

An operating cycle of the pump 10 will now be described in conjunction with FIG. 10, in particular. In the positions of the respective pistons 48 as illustrated it will be assumed that neither piston has engaged its sleeve valve 96 to shift the same forwardly toward the working fluid pump portion of the pump 10. Accordingly, the pressure supplied by the pump 118 will be sufficient to bias both sleeve valves 96 against the respective transverse edges 128 thereby placing both pilot actuators for the valve 124 in communication with the low pressure return conduit 204. However, thanks to the design of the valve spool 160 and its associated pilot actuators 169 and 172 the valve 124 will be biased into its position a, as indicated schematically in FIG. 10, so that high pressure operating fluid will be supplied to the chamber 50 of the actuator shown at the top of the schematic diagram while the chamber 50 of the other actuator is connected to the low pressure return conduit 204. Accordingly, one of the pistons 48 is being driven forwardly on its pumping stroke while pressure fluid is conducted through transfer passage 142 to move the other piston 48 rearwardly on its pump inlet or suction stroke. For the sake of further description of the operation of the control system the actuators 38 will be referred to as 38A and 38B as indicated in FIG. 10. When the piston 48 of actuator 38A shifts its sleeve valve 96 to its position a the valve 124 will be shifted to its position b thereby placing the cylinder chamber 50 of actuator 38A in communication with the low pressure return conduit 204 and placing the corresponding cylinder chamber of actuator 38B in communication with the high pressure power fluid circuit including the conduit 202. Accordingly, the piston 48 of actuator 38B will now be driven forwardly on its working fluid delivering stroke and fluid will be transferred from the chamber 52 of actuator 38B over to the corresponding chamber 52 of actuator 38A driving its piston rearwardly to displace operating hydraulic fluid out of the associated chamber 50 and through the low pressure return conduit 204 by way of valve 124.

As the piston 48 of actuator 38A begins movement rearwardly to displace operating fluid from the associated chamber 50 its sleeve valve 96 will follow with the piston until the valve end face 97 engages the transverse edge 128 of the cylinder 40. At this time, both sleeve valves 96 are biased rearwardly in engagement with their associated edge surfaces 128 and, accordingly, the respective pilot actuators of the valve 124 are in communication with the low pressure return circuit. Since the pilot actuators for the valve spool 160 are adapted to bias the valve 124 into its position a the valve would have a tendency to again shift to its position a prematurely if not provided with the locking feature provided by the cooperating portions of the pilot actuator piston 172, the groove 178 and the cooperating rim and reentrant edge portions 176 and 180, respectively.

When the valve 124 is shifted to position b pilot pressure fluid at return circuit pressure is acting on the axially projected cross-sectional areas of the bore 170 and the bore 174; however, the effective area of the pilot actuator bore 174 now includes the axially projected area of the spool provided by the groove 178 and, since pressure fluid cannot escape from the chamber formed by that groove due to the registration of the rim 176 with the reentrant edge 180, the valve 124 will not shift out of its position b until the piston 48 of actuator 38B engages its associated sleeve valve 96 and shifts same from its position b to its position a. At this time, upon engagement of the sleeve valve 96 by the piston 48 of actuator 38B pilot actuator bore 170 is again placed in communication with the transfer circuit fluid pressure and valve 124 is shifted back to its position a to supply pressure fluid to the chamber 50 of actuator 38A and to drain pressure fluid from the chamber 50 of actuator 38B to the low pressure return conduit 204. As the piston 48 of the actuator 38B returns to its retracted position its sleeve valve 96 moves back to its position b but valve 124 remains in its position a until valve 96 associated with actuator 38A is moved to its positoin a and the operating cycle is then repeated.

The working pressures of the pumps 200 and 118 and their associated circuits may be determined in accordance with the power and maximum working pressure requirements of the pump 10. Typically, the nominal working pressure of the pump 200 may be in the range of 2,500 to 4,000 psig and the low pressure return circuit to the pump 200 is normally in the range of 200 to 300 psig. Accordingly, the nominal working pressure of fluid in the transfer circuit as provided by the pump 118 should typically be maintained in the range of 350 to 400 psig. Those skilled in the art will recognize that the pressures may vary in accordance with particular design requirements.

Thanks to the arrangement of the transfer circuit for transferring fluid between the chambers 52 of the respective actuators 38 of the pump 10, and including the make up fluid as supplied by the pump 118, leakage flow of fluid from this circuit such as through the seals 70 will not effect the stroke length of the actuators 38 even though the effective stroke length is being provided by the transfer of fluid from one actuator chamber 52 to the corresponding chamber of the other actuator. The nominal capacity of pump 118 is only that which is required to overcome leakage from the transfer circuit and pilot actuator fluid flow and leakage. Moreover, the sleeve valves 96 are disposed in the low pressure or return fluid chambers of the actuators 38 whereby leakage flows are minimized. Those skilled in the art will also appreciate that the timing of the pump delivery strokes of the hydraulic actuators 38 provides a virtually constant rate of delivery of working fluid from the fluid end of the pump 10 thereby substantially reducing the variation in discharge flow even though the pump may comprise only two single acting pistons and cylinders.

Although one embodiment of a hydraulically actuated multi-cylinder reciprocating piston pump has been described herein those skilled in the art will recognize that various modifications and substitutions may be made to the specific design illustrated and described without departing from the scope and spirit of the invention as recited in the appended claims.

What I claim is:

1. A pressure fluid distributing valve useful in a hydraulically actuated reciprocating piston pump, said valve including a housing, a spool type valve closure member reciprocably disposed in a bore formed in said housing and movable between first and second positions for alternately valving pressure fluid from a high pressure fluid supply port to a working fluid port adapted to be in communication with actuator means for said pump, and closing off communication between said supply port and said working fluid port, respectively, pilot actuator means for moving said closure member in response to pilot pressure fluid signals conducted to said valve, said pilot actuator means comprising opposed axially extending bores formed in opposite ends of said closure member and of different diameter, and pilot actuator piston means projecting into said bores, respectively, said pilot actuator piston means being fixed with respect to said housing, passages in each of said pilot actuator piston means opening into said bores in said closure member for introducing pilot pressure fluid to respective ones of said bores for shifting said closure member between said first and second positions and whereby pilot pressure fluid at equal pressure in said passages will cause said valve to shift to one of said positions, and means for maintaining said closure member in the other of said positions when said closure member is in said other position and when pilot pressure fluid is being conducted to both of said pilot actuator means to prevent shifting of said closure member to said one position including an annular chamber formed by an enlarged portion of the one of said bores in said closure member of smaller diameter, a reentrant annular edge of said enlarged portion cooperable with an annular rim on said pilot actuator piston means associated with said one bore when said closure member is in said other position to trap pilot actuator fluid in said annular chamber to act on said closure member to hold said closure member in said other position, and passage means in said pilot actuator piston means associated with said one bore in communication with said annular chamber when said closure member is in said other position for conducting pilot pressure fluid to said annular chamber.

2. A pressure fluid distributing valve, said valve including a housing, a spool type valve closure member reciprocably disposed in a bore formed in said housing and movable between first and second positions for alternately valving pressure fluid from a fluid supply port to a working fluid port, and closing off communication between said supply port and said working fluid port, respectively, first and second pilot actuator means for moving said closure member to said first and second positions in response to pilot pressure fluid signals conducted to said valve, said pilot actuator means comprising opposed axially extending bores formed in opposite ends of said closure member, and opposed pilot actuator piston means in said housing and projecting into said bores, respectively, passage means in communication with said bores in said closure member for introducing pilot pressure fluid to respective ones of said bores for shifting said closure member between said first and second positions, and means cooperable with one of said bores and with pilot actuator poston means projecting into said one bore for maintaining said closure member in one of said positions only when said closure member is in said one position and when pilot pressure fluid is being conducted to both of said pilot actuator means at a pressure less than a predetermined pressure in the other of said bores to prevent shifting of said closure member to the other of said positions.

3. The valve set forth in claim 2 wherein:

said passage means include passages in each of said pilot actuator piston means opening into said bores in said closure member, respectively.

4. The valve set forth in claim 3 including:

removable orifice plug means disposed on said pilot actuator piston means and forming part of said passages for limiting the shifting speed of said valve in response to introduction of pilot pressure fluid into said bores in said closure member, respectively.

5. The valve set forth in claim 3 wherein:

said bores in said closure member are of different diameter whereby fluid at equal pressure in said passages in said pilot actuator piston means will cause said valve to shift to one of said positions.

6. The valve set forth in claim 2 wherein:

said means for maintaining said closure member in said one position includes a chamber formed by an enlarged portion of said one of said bores in said closure member, and passage means in said pilot actuator piston means associated with said one bore operable to be in communication with said chamber when said closure member is in said one position for conducting pilot pressure fluid to said chamber, said passage means in said pilot actuator piston means associated with said one bore being blocked to prevent communication with said chamber when said closure member is in the other of said first and second positions.

* * * * *